US006045006A

United States Patent [19]

Frazier et al.

[11] Patent Number: 6,045,006

[45] Date of Patent: Apr. 4, 2000

[54] DISPOSABLE LIQUID CONTAINING AND DISPENSING PACKAGE AND AN APPARATUS FOR ITS MANUFACTURE

[75] Inventors: Steven G. Frazier, Stockbridge; Hsar Hmun, Norcross, both of Ga.; Steven Gosling, Brampton; Michael Coo, Burlington, both of Canada

[73] Assignee: The Coca-Cola Company, Atlanta, Ga.

[21] Appl. No.: 09/089,151

[22] Filed: Jun. 2, 1998

[51] Int. Cl.[7] ..... B65D 35/56

[52] U.S. Cl. ..... 222/105; 222/464.2

[58] Field of Search ..... 222/95, 105, 183, 222/464.1, 464.2, 107

[56] References Cited

U.S. PATENT DOCUMENTS

| | | | |
|---|---|---|---|
| 2,133,411 | 10/1938 | Zohe | 128/252 |
| 2,569,975 | 10/1951 | Cone | 169/31 |
| 2,804,257 | 8/1957 | Hasler et al. | 229/62.5 |
| 2,859,899 | 11/1958 | Kramer et al. | 222/95 |
| 2,891,700 | 6/1959 | Maynard | 222/92 |
| 2,920,798 | 1/1960 | Samuel | 222/394 |
| 3,081,911 | 3/1963 | Scholle | 222/107 |
| 3,083,875 | 4/1963 | Welty et al. | 222/95 |
| 3,090,526 | 5/1963 | Hamilton et al. | 222/105 |
| 3,171,571 | 3/1965 | Daniels | 222/94 |
| 3,197,073 | 7/1965 | Gondra | 222/107 |
| 3,240,399 | 3/1966 | Frandeen | 222/95 |
| 3,257,036 | 6/1966 | Micallef | 222/95 |
| 3,260,412 | 7/1966 | Larkin | 222/95 |
| 3,342,377 | 9/1967 | Perdey | 222/94 |
| 3,361,303 | 1/1968 | Jacuzzi | 222/183 |
| 3,420,413 | 1/1969 | Corsette | 222/107 |
| 3,549,050 | 12/1970 | Bruce et al. | 222/95 |
| 3,695,314 | 10/1972 | Watts et al. . | |
| 3,718,236 | 2/1973 | Reyner et al. | 222/386.5 |
| 3,838,794 | 10/1974 | Cogley et al. | 222/95 |
| 3,981,415 | 9/1976 | Fowler et al. | 222/95 |
| 4,014,461 | 3/1977 | Harvill | 222/94 |
| 4,062,475 | 12/1977 | Harris et al. | 222/95 |
| 4,087,026 | 5/1978 | Petterson | 222/386.5 |
| 4,137,930 | 2/1979 | Scholle | 137/68 |
| 4,138,036 | 2/1979 | Bond | 222/105 |
| 4,148,416 | 4/1979 | Gunn-Smith | 222/94 |
| 4,159,790 | 7/1979 | Bailey | 222/211 |
| 4,193,518 | 3/1980 | Holmes | 222/105 |
| 4,257,535 | 3/1981 | Mellett | 222/92 |
| 4,265,373 | 5/1981 | Stoody | 222/94 |
| 4,266,692 | 5/1981 | Clark | 222/94 |
| 4,270,533 | 6/1981 | Andreas | 128/214 |
| 4,284,671 | 8/1981 | Cancio et al. | 428/35 |
| 4,286,636 | 9/1981 | Credle | 141/114 |
| 4,322,020 | 3/1982 | Stone | 222/95 |
| 4,362,255 | 12/1982 | Bond | 222/107 |
| 4,381,846 | 5/1983 | Heck | 222/105 |

(List continued on next page.)

FOREIGN PATENT DOCUMENTS

| | | |
|---|---|---|
| 600684 | 6/1960 | Canada . |
| 732761 | 6/1955 | United Kingdom . |
| 756093 | 8/1956 | United Kingdom . |
| 1473524 | 5/1977 | United Kingdom . |
| WO 83/01605 | 5/1983 | WIPO . |
| WO 85/04383 | 10/1985 | WIPO . |
| WO 86/00868 | 2/1986 | WIPO . |

OTHER PUBLICATIONS (3) Photograph of a BIB bag manufactured in New Zealand by the Liquipac division of AEP. No Date.

*Primary Examiner*—Philippe Derakshani
*Attorney, Agent, or Firm*—Jones & Askew, LLP

[57] ABSTRACT

A disposable liquid containing and dispensing package. The package has a flexible bag with an upper and a lower bag wall. The upper and lower bag walls have a periphery and a middle portion. The upper bag wall has a spout positioned within the middle portion of the wall. The spout has a first side and a second side. A dip strip is attached to the upper bag wall on the first side of and spaced apart from the spout and attached to the middle portion of the upper bag wall on the second side of and spaced apart from the spout.

24 Claims, 4 Drawing Sheets

U.S. PATENT DOCUMENTS

| | | | |
|---|---|---|---|
| 4,445,550 | 5/1984 | Davis et al. | 141/329 |
| 4,513,884 | 4/1985 | Magid | 222/94 |
| 4,524,458 | 6/1985 | Pongrass et al. | 383/33 |
| 4,601,410 | 7/1986 | Bond | 222/92 |
| 4,893,731 | 1/1990 | Richter | 222/92 |
| 4,998,990 | 3/1991 | Richter et al. | 222/92 |
| 5,178,021 | 1/1993 | Kosuth | 222/464.2 |
| 5,647,511 | 7/1997 | Bond | 222/105 |
| 5,743,435 | 4/1998 | Tomic | 222/105 |
| 5,749,493 | 5/1998 | Boone et al. | 222/105 |
| 5,915,596 | 6/1999 | Credle, Jr. | 222/464.1 |

DISPOSABLE LIQUID CONTAINING AND DISPENSING PACKAGE AND AN APPARATUS FOR ITS MANUFACTURE

RELATED APPLICATIONS

Application Ser. No. 09/041,609, filed Mar. 13, 1998, entitled "Method and Apparatus for Maintaining a Fluid Pouch", is attached hereto as Exhibit A. This application is assigned to The Coca-Cola Company, the assignee of the present application. This application discloses a disposable liquid containing and dispensing package and also a method and an apparatus for its manufacture. This application is incorporated herein by reference. If this application is allowed, then Appendix A will be cancelled and reference to the allowed subject matter will be substituted as provided by MPEP §608.01 (p). If this application is not allowed or is abandoned, then such subject matter will be incorporated in the specification of this application by amendment.

TECHNICAL FIELD

The present invention relates to a bag for a bag-in-box type package and an apparatus for its manufacture, and more particularly relates to a bag with a dip strip positioned and sealed therein and an apparatus for its manufacture.

BACKGROUND OF THE INVENTION

Bag-in-box packages are well known for containing and dispensing liquids such as syrup for post-mix soft drink dispensers. Such known packages include an outer protective and supporting box made of corrugated cardboard and an inner, flexible, collapsible plastic bag containing the syrup. The plastic bag has a spout for feeding the syrup to the post-mix beverage dispenser via a hose and a pump. A plastic dip strip or dip tube is often included within the bag to assist in withdrawing the syrup. The dip strip prevents the bag from collapsing upon itself while the syrup is being withdrawn.

An example of a commercially available bag with a dip strip positioned therein is shown in U.S. Pat. No. 5,647,511 to Bond. This reference describes a plastic bag with a spout on one end. A "plastic evacuation insert" or a dip strip has a mounting ring with a multi-channel dip strip extending radially therefrom. The dip strip is connected directly to the spout and directly across from the mouth of the spout. The dip strip does not extend the entire length of the bag.

Although the design of this dip strip assists in withdrawing the fluid from the bag, the design has several drawbacks. First, because the dip strip is not anchored at both ends, the free end of the dip strip on occasion can puncture the lower end of the bag. Further, the free end of the dip strip may become twisted or curved within the bag and allow a portion of the bag to become sealed off and inaccessible. Second, because the spout and the dip strip are directly connected, the fluid fill time of the bag is somewhat slow and inadequate. There is insufficient clearance between the spout and the dip strip to allow a high volume of fluid to be poured into the bag in a given amount of time. The dip strip and the spout create a bottle-neck effect limiting the fill time of the bag. Third, the attachment of the dip strip directly across from the spout also allows the incoming stream of fluid to knock or dislodge the dip strip away from the spout. Once the dip strip is dislodged, the bag wall opposite the spout may be sucked into the spout. The spout is then sealed off although the bag still contains fluid.

Another example of a bag with a dip strip therein is shown in U.S. Pat. No. 5,749,493 to Boone, et al., owned by The Coca-Cola Company, the assignee of the present invention. This reference shows, among other things, a ribbed dip strip sealed between the upper and lower bag walls at the top and bottom ends. This design provides sufficient clearance between the dip strip and the spout so as to permit faster fill time because the dip strip and the spout are not directly connected. Further, because both ends of the dip strip are anchored, the dip strip remains in place at all times to reduce the likelihood of the bag collapsing. U.S. Pat. No. 5,749,493 is incorporated herein by reference.

A further improvement is shown in U.S. Pat. No. 5,915,596. U.S. Pat. No. 5,915,596 is incorporated herein by reference. This reference also shows, among other things, a bag with a ribbed dip strip sealed between the upper and lower bag walls at the top and bottom ends. In this reference, however, the ends of the dip strip that are sealed within the bag walls are notched so as to remove the ribbed portion of the dip strip from the seal. By removing this portion of the dip strip, a higher quality seal is possible between the bag walls and the dip strip. Application Ser. No. 09/041,609, Appendix A attached hereto, describes in detail the apparatus and the method of manufacture of such a pouch in a high-speed, efficient manner.

SUMMARY OF THE INVENTION

The present invention provides a disposable liquid containing and dispensing package. The package has a flexible bag with an upper and a lower bag wall. The upper and lower bag walls have a periphery and a middle portion. The upper bag wall has a spout positioned within the middle portion of the wall. The spout has a first side and a second side. A dip strip is attached to the upper bag wall on the first side of and spaced apart from the spout and attached to the middle portion of the upper bag wall on the second side of and spaced apart from the spout.

Specific embodiments include attaching the dip strip to the upper bag wall at a predetermined distance from the spout. The dip strip is attached to the periphery and/or the middle portion of the upper bag wall on the first side of the spout. In addition to the middle portion, the dip strip also may be attached to the periphery of the upper bag wall on the second side of the spout. The dip strip is attached to the upper bag at one or more contact points. The contact points on the middle portion of the upper bag wall may include a pair of upper contact points, a pair of center contact points, and a pair of lower contact points. In fact, any number of contact points may be used. The contact points should be spaced sufficiently apart from one another to allow fluid to pass between them and into the dip strip.

The bag walls and the dip strip may be made from a plastic material. The contact points may be an area of fused plastic material. The dip strip also may have a flat base and a central ribbed portion. The flat base of the dip strip is attached to the upper bag wall at the contact points while the central ribbed portion generally faces the upper bag wall. The central ribbed portion has essentially parallel ribs so as to provide a plurality of liquid passages thereon. The liquid passages stay in liquid communication with the spout as the bag progressively collapses as fluid is removed.

The dip strip further includes a pair of flat ends. The flat ends include the flat base with the central ribbed portion removed. The flat ends of the dip strip are sealed between said bag walls at the periphery.

A method of producing the pouch of the present invention includes the steps of attaching the spout to the first bag wall, attaching the dip strip to the first bag wall at at-least one location spaced a predetermined distance apart from the spout, and seaming the bag walls at one or more peripheral edges thereof so as to form the pouch. The method may further include the step of seaming the ends of the dip strip between the one or more peripheral ends of the bag walls.

An apparatus for manufacturing the pouch of the present invention includes means for advancing a predetermined length of a continuous strip of dip strip material along a predetermined path, means for punching a hole in the dip strip material, means for inserting the dip strip material adjacent to a first continuous strip of flexible material, means for attaching the dip strip material to the first continuous strip of flexible material at one or more contact points, means for advancing a second continuous strip of flexible material, means for sealing a plurality of lateral lines along the continuous strips of the flexible material, and means for sealing the dip strip between the continuous strips of flexible material in the vicinity of the dip strip hole such that a transverse seal line is created and the flexible pouch is formed.

It is thus an object of the present invention to provide an improved bag for a bag-in-box package.

It is another object of the present invention to provide a method and an apparatus for the assembly of such an improved bag for a bag-in-box package.

It is a yet another object of the present invention to provide a bag for a bag-in-box package with increased efficiency in withdrawing fluid therefrom.

It is further object of the present invention to provide a method and an apparatus for the manufacture of a bag for a bag-in-box package with increased efficiency in withdrawing fluid therefrom.

It is a still further object of the present invention to provide a dip strip for use in a bag for a bag-in-box package with increased suction to assist in withdrawing fluid from the bag.

It is a still further object of the present invention to provide a method and an apparatus for the manufacture of a dip strip for use in a bag for a bag-in-box package with increased suction to assist in withdrawing fluid from the bag.

It is an even further object of the present invention to provide a bag for a bag-in-box package that permits high speed filing of the bag.

It is an even further object of the present invention to provide a method and an apparatus for the manufacture of a bag for a bag-in-box package that permits high speed filing of the bag.

Other objects, features, and advantages of the present invention will become apparent upon review of the following description of the preferred embodiments of the present invention, when taken in conjunction with the drawings and the appended claims.

DETAILED DESCRIPTION OF THE INVENTION

The Pouch

Figure 1:
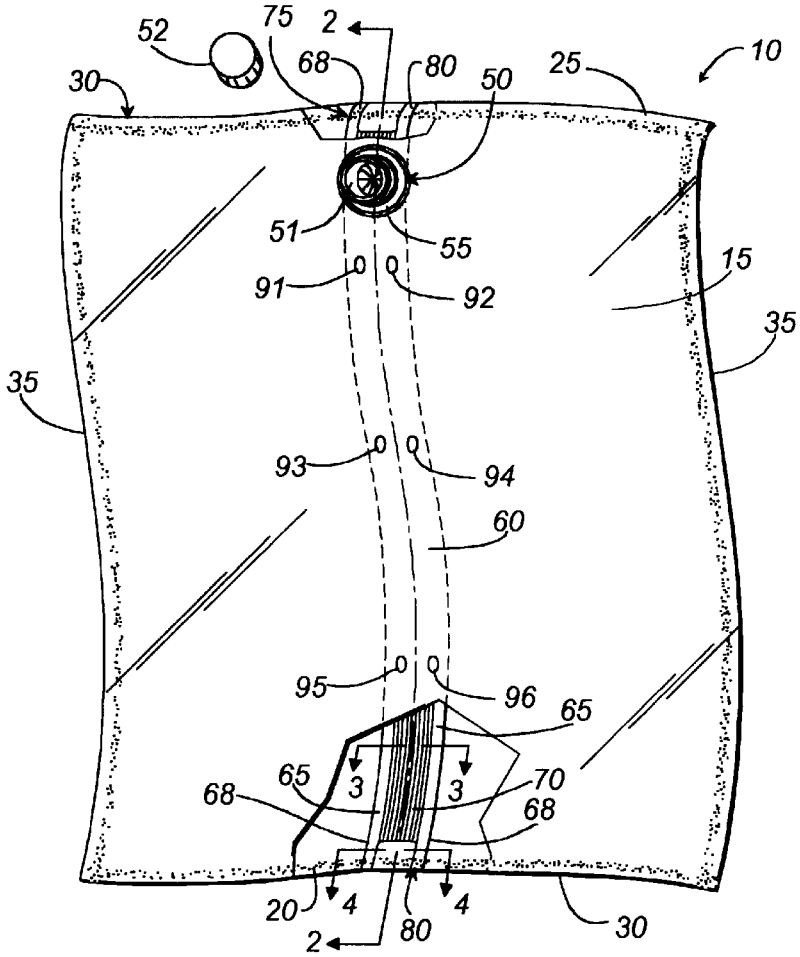
FIG. 1 is a partial cut away view of the pouch of the present invention showing the dip strip.

Referring now in more detail to the drawings in which like numerals refer to like parts throughout the several views, FIGS. 1–4 show a pouch 10 of the present invention. The pouch 10 includes a pair of flexible walls 15, 20 sealed together at a first end 25, a second end 30, and along the lateral sides 35. The ends 25, 30 and the lateral sides 35 form a periphery of each wall 15, 20 with the remainder of each wall 15, 20 forming a middle portion. Each wall 15, 20 preferably has two (2) plys of material, an inner ply 40 and an outer ply 45. The inner ply 40 may be a web of two (2) mil Linear Low Density Polyethylene ("LLDPE") or similar materials. The outer ply 45 may be a four (4) mil co-extrusion layer of LLDPE/nylon/ALLDPE, with tie layers on each side of the nylon, or similar materials. The two (2) LLDPE layers are preferably about 1.4 mil, the nylon about 1.0 mil, and the tie layers about 0.1 mil.

Figure 2:
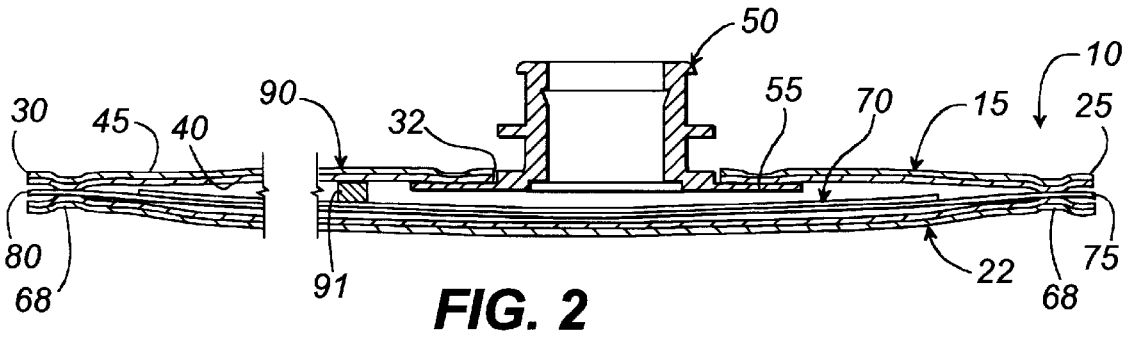
FIG. 2 is a cross-sectional view of the pouch taken along line 2—2 of FIG. 1.

The pouch 10 has a spout 50 positioned near one of the ends 25, 30 of the pouch 10. The spout 50 may have an internal valve 51 therein and is generally closed by a cap 52. As is shown in FIG. 2, the spout 50 also has a flange 55 surrounding the spout 50. The flange 55 is sealed to the upper pouch wall 15 to keep the spout 50 in place and to prevent fluid from leaking out of the pouch 10. The pouch 10 is filled and emptied through the spout 50.

The pouch 10 further includes a flexible dip strip 60 that is aligned underneath the spout 50 and the upper wall 15. The dip strip 60 provides for fluid communication between the spout 50 and the far reaches of the pouch 10. By attaching the dip strip 60 to the ends 25, 30 of the pouch 10, the likelihood of inadvertent folding of the pouch 10 between the spout 50 and the dip strip 60 during evacuation is reduced or minimized. Any such inadvertent folding can lead to incomplete emptying of the pouch 10.

Figure 3:
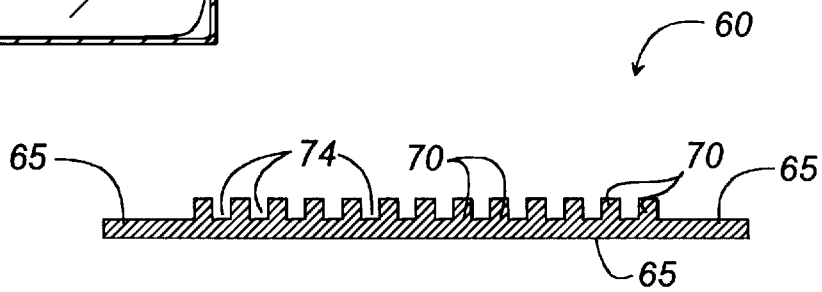
FIG. 3 is a cross-sectional view through the dip strip taken along line 3—3 of FIG. 1.
Figure 4:
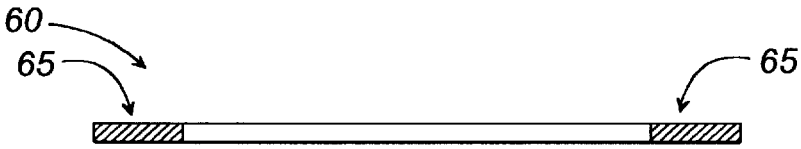
FIG. 4 is a cross-sectional end view through the flat ends of the dip strip taken along line 4—4 of FIG. 1.

The dip strip 60 is preferably made of a flexible plastic material such as an extruded polyethylene or similar types of flexible, heat-sealable materials. As is shown in FIGS. 1 and 3, the dip strip 60 includes a flat base 65, a plurality of ribs 70 running substantially the entire length of the dip strip 60 along the flat base 65, a first end 75, and a second end 80. The ribs 70 are preferably parallel to each other and provide a plurality of liquid passages 74 that, in turn, provide fluid communication along substantially the entire length of the dip strip 60.

As is shown in FIGS. I and 4, the first and second ends 75, 80 of the dip strip 60 are substantially "U"-shaped, in that the ribs 70 and that portion of the flat base 65 underneath the ribs 70 have been removed such that only the ends of flat base 65 remains, i.e., only one or more flanges 68 of the flat base 65 remain. Once this ribbed material is removed, the first and second ends 75, 80 of the dip strip 60 are sealed into place between the two walls 15, 20 at the first end 25 and the second end 30 of the pouch 10. The dip strip 60 is thus secured within the pouch 10 and positioned substantially underneath the spout 50.

In addition to securing the dip strip 60 within the walls 15, 20 of the pouch 10 at its periphery, i.e., the first and the second ends 25, 30, the dip strip 60 also is attached to the upper wall 15 at one or more contact points 90 positioned along the middle of the pouch 10. The contact points 90 preferably connect the flat base 65 of the dip strip 60 to the upper wall 15. The contact points 90 are preferably created by a heat sealing method such that the plastic material of the dip strip 60 and the upper wall 15 are fused together. The contact points 90, however, also can be created by adhesives or other types of conventional fastening methods or devices. Although the term contact "point" is used herein, it is understood that the area of contact can be almost any shape or size. By connecting the dip strip 60 to the upper wall 15 at the contact points 90, the ribs 70 and the upper wall 15 ensure that the fluid passages 74 operate efficiently in drawing fluid from the far reaches of the pouch 10, much like a straw draws fluid out of a cup. The fluid enters the fluid passages 74 through the spaces between the contact points 90 and is drawn towards the spout 50 by suction.

The contact points 90 are preferably spaced at least a predetermined distance from the spout 50. This predetermined distance allows some "give" in the dip strip 60 to permit high speed filing of the pouch 10. Because the dip strip 60 is not connected to the upper wall 15 in the immediate vicinity of the spout 50, the dip strip 60 does not create the bottle-neck effect found in the prior art.

This embodiment of the present invention employs six (6) contact points 90. These contact points 90 include two (2) upper contact points 91, 92, two (2) center contact points 93, 94, and two (2) lower contact points 95, 96. The upper contact points 91, 92 are positioned towards the first end 25 of the pouch 10 at a sufficient distance beneath the spout 50 in the direction of the length of the pouch 10 so as to permit unimpeded filling of the pouch 10 through the spout 50. A first upper contact point 91 is positioned on the flat base 65 on one side of the ribs 70 and a second upper contact point 92 is positioned on the opposite side of the ribs 70 in the direction perpendicular to the length of the pouch 10.

The center set of contact points 93, 94 is positioned essentially in the center of the pouch 10 in the direction along the length of the pouch 10. As with the upper contact points 91, 92, a first center contact point 93 is on the flat base 65 on one side of the ribs 70 while a second center contact point 94 is positioned on the opposite side of the rib 70 in the direction perpendicular to the length of the pouch 10. The lower contact points 95, 96 are positioned near the second end 30 of the pouch 10 in the direction along the length of pouch 10. A first lower contact point 95 is positioned on the flat base 65 on one side of the ribs 70 while a second lower contact point 96 is positioned on the opposite side of the rib 70 in the direction perpendicular to the length of the pouch 10.

In addition to the contact points 90 described above, the ends 75, 80 of the dip strip 60 that are sealed within the first and second ends 25, 30 of the pouch 10 also act as a contact point 90 in that the dip strip 60 is in contact with the upper wall 15. The dip strip 60 is therefore connected to the upper wall 15 of the pouch 10 on either side of the spout 50. Alternatively, the contact points 90 also could be used in place of sealing the first and second ends 75, 80 of the dip strip 60 between the first and second ends 25, 30 of the walls 15, 20. In this embodiment, the dip strip 60 would only be connected to the upper wall 15 of the pouch 10 via the contact points 90. Preferably, one or more of A M the contact points 90 would be located on either side of the spout 50.

Although (6) six contact points 90 and the anchoring of the first and second ends 75, 80 of the dip strip 60 within the walls 15, 20 of the pouch 10 have been disclosed herein, almost any combination of the contact points 91 through 96 disclosed herein would be adequate. In fact, almost any number of contact points 90 may be utilized. The contact points 90 preferably should be spaced a sufficient distance in the direction along the length of the dip strip 60 from the spout 50 to permit rapid filing of the pouch 10. Further, there should be a sufficient distance between the respective contact points 90 to permit the ingress of fluid into the fluid passages 74. The fluid passages 74 of the dip strip 60 will act as a straw to assist in withdrawing fluids from the pouch 10 as long as the dip strip 60 and the upper wall 15 are in close proximity.

The Apparatus

Figure 6C:
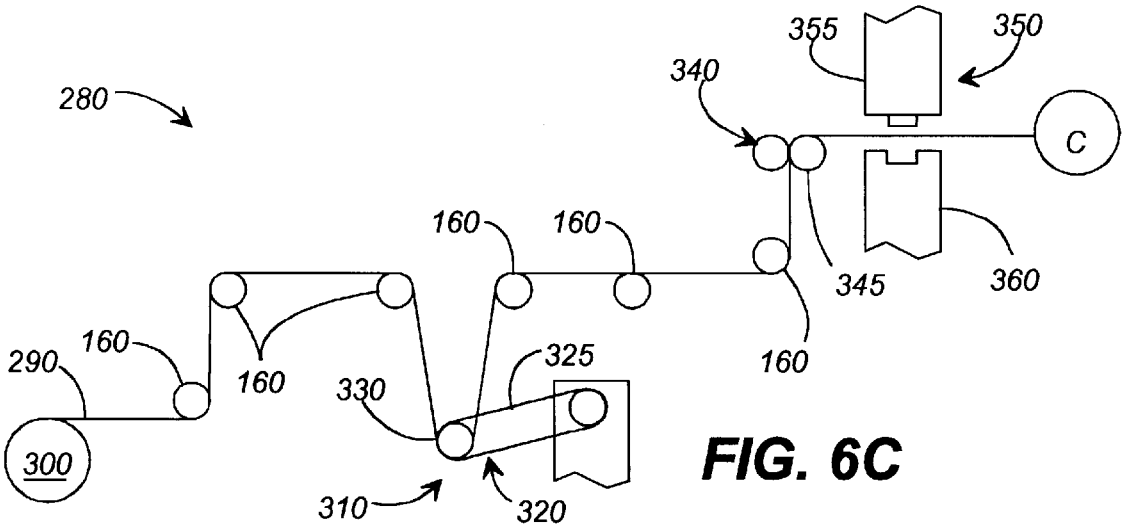
FIG. 6 A–C are schematic sectional views showing the major elements of the present invention used in the manufacture of the pouch.
Figure 5:
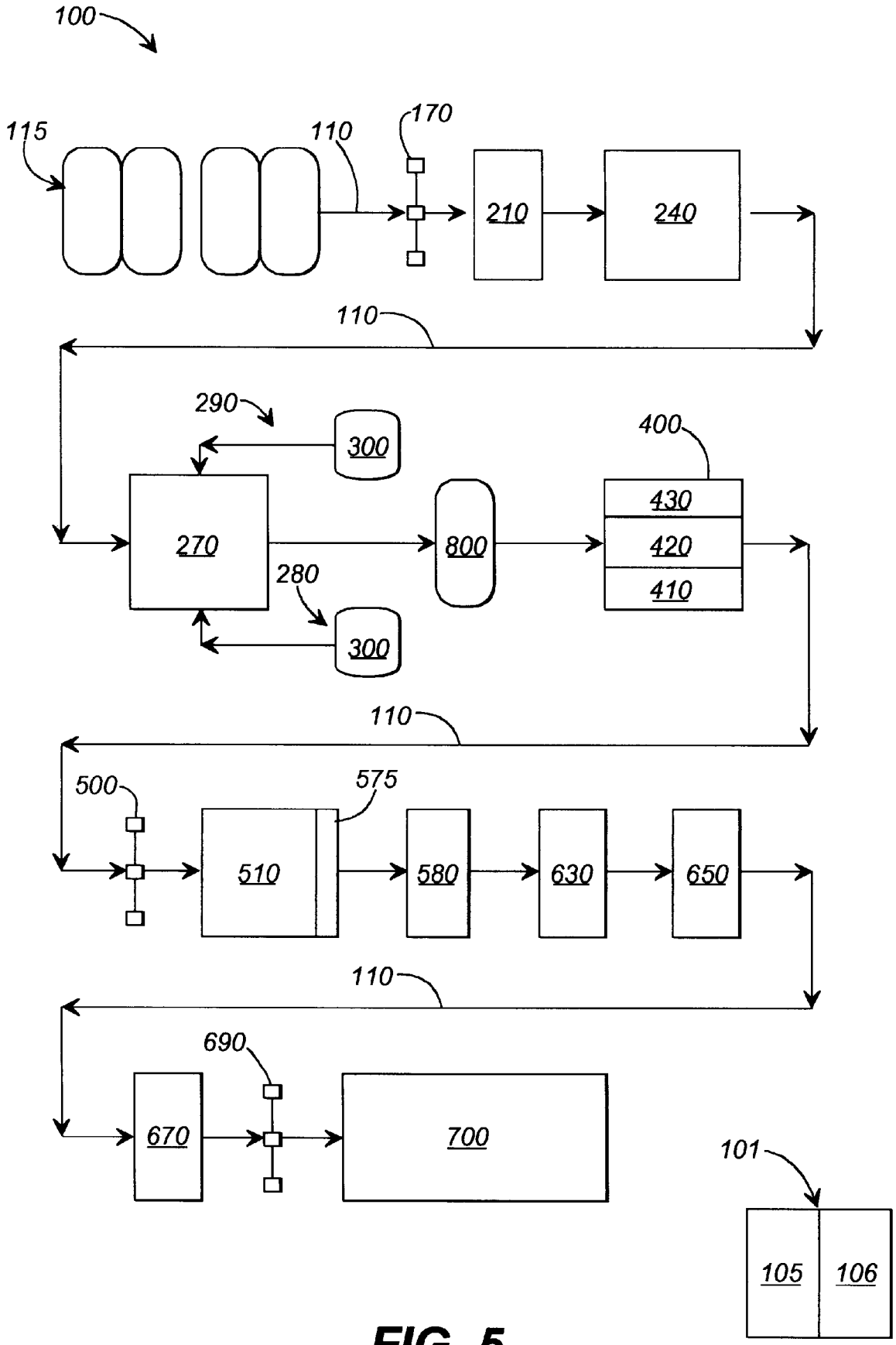
FIG. 5 is a schematic view showing the major elements involved in the manufacture of a pouch according to the present invention.
Figure 6A:
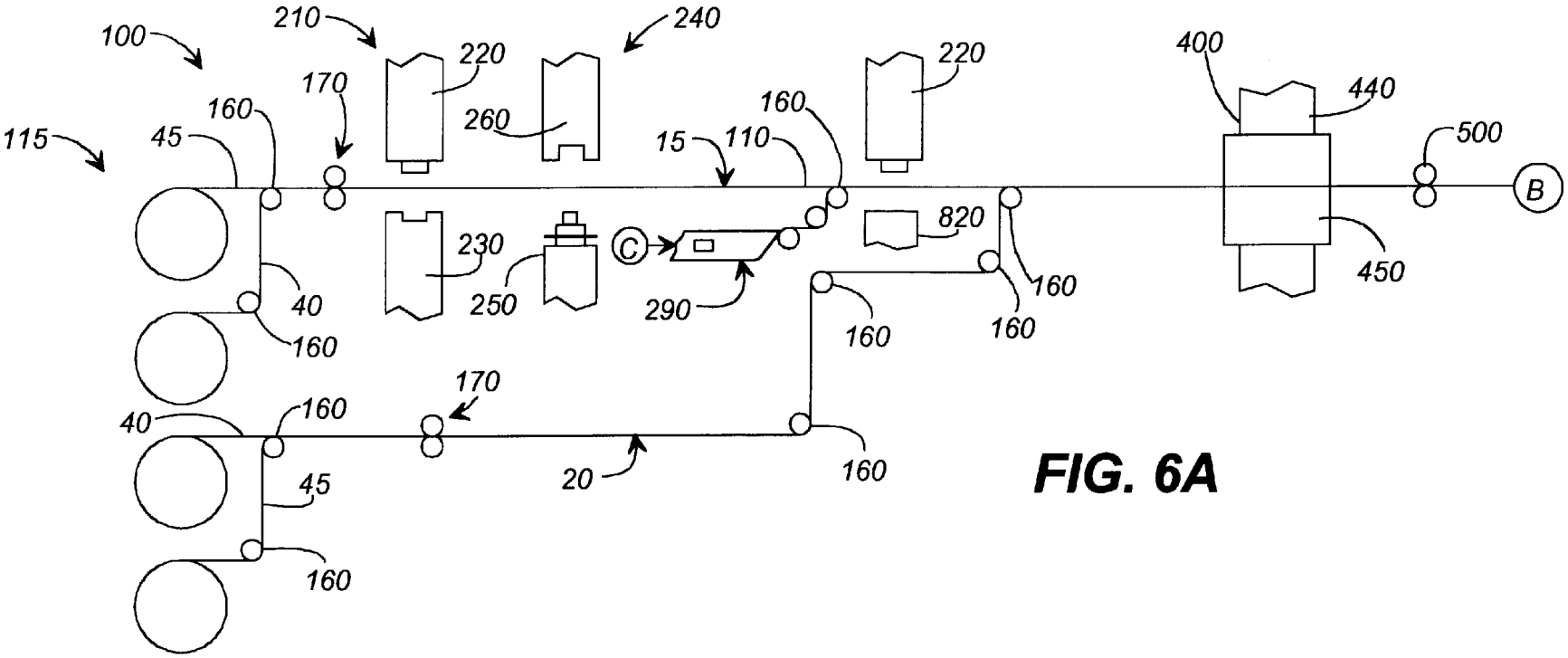
Figure 6B:
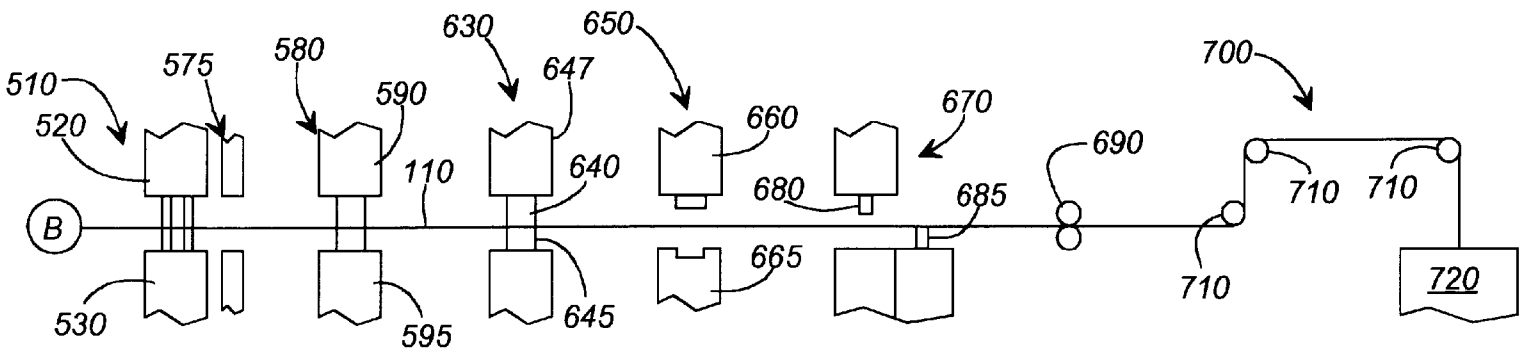

The pouch 10 of the present invention is manufactured in a manner similar to that described in application Ser. No. 09/041,609, incorporated herein by reference. FIGS. 5–6 show schematic views of an apparatus 100 for making the pouch 10. The apparatus 100 is operated by one or more control systems 101. The control systems 101 include a controller 105, such as a standard microprocessor-based Programmable Logic Controller ("PLC"). The controller 105 enables the user to set the variables of the apparatus 100 such as the temperature and dwell time of the presses described below. The controller 105 includes a standard screen, disc drive, key board, and memory (not shown). The control systems 101 also may include a data monitor 106, such as a standard Personal Computer with a data acquisition card (not shown). The data monitor 106 monitors and records the temperature, force, and dwell time of the presses described below.

The apparatus 100 operates in assembly line fashion along a predetermined path 110. The apparatus 100 includes a plurality of material rolls 115, loaded with the outer plys 45 and the inner plys 40 to form the upper walls 15 and the lower walls 20. The outer plys 45 and the inner plys 40 are pulled off of the material rolls 115 onto the predetermined path 110 along a plurality of rollers 160 by a plurality of feed servos 170.

The upper wall 15 then passes through a hole punch assembly 210. The hole punch assembly 210 preferably has a fixed upper punch 220 positioned above the upper wall 15 and a vertically movable pneumatic die 230 positioned below the upper wall 15 (or vice versa). The hole punch assembly 210 punches a spout receiving hole 32 into the upper wall 15. The upper wall 15 then continues to the spout insert assembly 240 positioned along the predetermined path 110. The spout insert assembly 240 preferably includes both a pneumatic cylinder and piston unit 250 that supports a spout 50 and moves it into the spout receiving hole 32 and also an upper fixed heating element 260 (or vice versa) that heat seals the flange 55 of the spout 50 to the upper wall 15.

The next station on the predetermined path 110 is the dip strip punch station 270. The upper and lower walls 15, 20 pass over and under the dip strip punch station 2 70 respectively. The dip strip punch station 270 may include two (2) identical feed assemblies, a left feed assembly 280 and a right feed assembly 285, depending upon the number of pouches 10 being manufactured at one time. The feed assemblies 280, 285 each include a spool 300 with a continuous strip of dip strip material 290 thereon. The dip strip material 290 is unwound from the spool 300 by a dancer system 310. The dancer system 310 preferably includes a dancer arm 320 having an air-cylinder operated lever arm 325 and a roller 330. The dip strip material 290 is pulled by the dancer arm 320 into a servo-driven roller apparatus 340 having a pair of gear driven rollers 345. After the servo apparatus 340 pulls a sufficient length of the dip strip material 290 from the dancer arm 320, the servo 340 locks the material 290 in place such that the dancer arm 320 can pull more material 290 off of the spool 300. The dip strip material 290 is then pulled towards a punch station 350. The punch station 350 preferably has a vertically moveable pneumatic punch 355 and a fixed die 360 (or vice versa). The punch station 350 punches out the material in the ends 75, 80 of two (2) adjoined dip strips 60.

The dip strip material 290 is then maneuvered into the predetermined path 110 directly underneath the upper wall 15 via the rollers 160. Likewise, the lower wall 20 is maneuvered into the predetermined path 110 directly underneath the dip strip material 290 via the rollers 160. The joined walls 15, 20 and the dip strip material 290 then travel together along the predetermined path 110 through a side sealer apparatus 400. The side sealer apparatus 400 may include three (3) identical pneumatic sealing units, left sealing unit 410, center sealing unit 420, and right sealing unit 430. The sealing units 410, 420, 430 seal the upper and lower walls 15, 20 together along a plurality of lateral lines. These lines include the left and right lateral edges 35 of the pouch 10. Each sealing unit 410, 420, 430 preferably has an air cylinder operated upper die unit 440 and an air cylinder operated lower die unit 450.

The walls 15, 20 are then advanced along the predetermined path 110 by a middle servo unit 500 into a pneumatic cross sealer apparatus 510. The cross sealer apparatus 510 preferably has an air cylinder operated upper die unit 520 and an air cylinder operated lower die unit 530. The cross sealer 510 seals the walls 15, 20 in the direction perpendicular to the direction of travel along the predetermined path 110 along the first and second ends 25, 30. The first end 75 of the dip strip 60 is sealed at the first end 25 of the pouch 10 and the second end 80 of the dip strip 60 is sealed at the second end 30 of the pouch 10. As described above, the ribbed portion 70 of the first and second ends 75, 80 of the dip strip 60 has been removed such that only the flanges 68 of the flat base 65 are within the seal. The ribs 70 are removed to ensure that no excess material is present that might prevent a water-tight seal or that might extend the cooling time of the seal. Further, removal of the ribs 70 ensures that there are no sharp edges in the seal that may puncture the pouch 10. The pneumatic cross sealer apparatus 510 also may include a clamp apparatus 575. The clamp apparatus 575 clamps down on the dip strip 60 between the walls 15, 20 to relieve any tension on the dip strip 60 while the cross sealer 510 is in operation.

The walls 15, 20 then advance along the predetermined path 110 through a pneumatic segment sealer apparatus 580 preferably having an air cylinder operated upper die unit 590 and an air cylinder operated lower die unit 595. The segment sealer 580 is designed to further heat and press the seal in the first and second ends 25, 30 of the pouch 10 to ensure that the plastic dip strip material 290 is melted and flattened for a sufficient seal.

The walls 15, 20 then pass along the predetermined path 110 through a clamp cooling station 630. The clamp cooling station 630 has an upper clamp bar 640 and a lower clamp bar 645. At least one of the clamp bars 640, 645 is water cooled by conventional means. The clamp bars 640, 645 are applied to the walls 15, 20 preferably by at least one (1) pneumatic cylinder 647 in the vicinity of the first and second ends 25, 30. The clamp bars 640, 645 reduce the temperature of the material therein. The reduction in temperature generally provides a stronger seal and permits the seal to be quickly cut as described below.

The walls 15, 20 then pass along the predetermined path 110 through a punch station 650. The punch station 650 preferably has a conventional vertically moveable pneumatic upper punch 660 and a fixed lower die 665 (or vice versa). The punch station 650 may be used to remove any excess dip strip material 290 in the area of the first and second ends 25, 30.

The walls 15, 20 are then passed along the predetermined path 110 through a serration station 670. The serration station 670 includes a movable serration wheel 680 that travels in a perpendicular direction to the predetermined path 110 and perforates the pouches 10 between the respective first and second ends 25, 30. The serration station 680 leaves the individual pouches 10 connected to each other by small tabs of material. The pouches 10 can then be easily pulled apart later for individual use. A fixed serration wheel or knife 685 also may be positioned in the middle of the predetermined path 110 depending upon the number of pouches 10 made at one time.

The pouches 10 then pass along the predetermined path through a loading servo 690 into a stacking device 700. The stacking device 700 has a series of movable rollers 710 that stack the pouches 10 in a vertical fashion into a tote bin 720 or other conventional loading device for storage or transport.

The present invention also provides for an additional station, the contact point apparatus 800. The contact point apparatus 800 is positioned along the predetermined path 110 between the rollers 160 that position the dip strip material 290 underneath the upper wall 15 and the rollers 160 that position the lower wall 20 underneath both the upper wall 15 and the dip strip material 290. The contact point apparatus 800 preferably includes an air cylinder-operated upper press unit 810 and a lower die unit 820. The upper press unit 810 is movable while the lower die unit 820 is stationery (or vice versa). The upper press unit 810 is heated by conventional heating elements (not shown) and controlled by conventional thermocouples (not shown). The temperature and dwell unit with which the upper press unit 810 operates is controlled by the controller 105, while these variables and the force applied are monitored and recorded by the data monitor 106. The upper press unit 810 may have multiple heads 840 to produce the opposing contact points 90 on either side of the ribs 70. Alternatively, multiple press units 810 may be used. The heads 840 may be rubber coated. The upper press unit 810 is timed to strike the upper wall 15 of the pouch 10 to create as many contact points 90 as are desired for a given pouch 10.

More details on the elements of the apparatus 10 and their use are included in application Ser. No. 09/041,609. For example, elements such as positioning sensors, film cleaners, static inducers, and brushes, as described therein, may be used in the apparatus 10.

The Method of Manufacture

In use, the walls 15, 20 are pulled off of the rolls 115 by the feed servos 170 onto the predetermined path 110. The upper wall 15 passes through the hole punch station 210 in which the spout receiving hole 32 is punched therethrough. The upper wall 15 then passes through the spout insert station 240 and the spout 50 is positioned within the hole 32 and the flange 55 is heat sealed into place. As the spout 50 is being inserted into the upper wall 15, the dip strip material 290 is removed from the spool 300 by the dancer system 310. The predetermined length of the dip strip material 290 is measured out by the servos 340 and advanced into the punch station 350. The ribbed section 70 of the dip strip material 290 is punched out in the first and second ends 75, 80 of the dip strip material 290.

The dip strip material 290 is then positioned underneath the upper wall 15 along the predetermined path 110. The upper wall 15 and the dip strip material 290 are then pulled through the contact point apparatus 800. The heated upper press 810 of the contact point apparatus 800 repeated strikes the upper wall 15 between the dip strip 60 and the fixed lower die 820 so act to create the contact points 90. The plastic material within the upper wall 15 and the dip strip material 290 melts and fuses together to form the contact points 90. Although six (6) contact points 90 are shown in FIG. 1, almost any number, shape, or size of the contact points 90 may be used.

The lower wall 20 is then aligned with the upper wall 15 and the dip strip material 290 along the predetermined path 110. The combined walls 15, 20 and the dip strip material 290 then advance into the side sealer 400 in which the lateral edges 35 of the walls 15, 20 are heat sealed together. The walls 15, 20 are then pulled through the middle servos 500 and into the cross sealer 510. The cross sealer 510 seals the first and the second ends 75, 80 of the dip strip 60 between the upper and lower walls 15, 20. The flanges 68 of the flat base 65 of the dip strip material 290 must be flattened by about fifty percent (50%) for an adequate seal. The walls 15, 20 are then advanced to the segment sealer 580 in which the seal in the vicinity of the first and second ends 75, 80 of the dip strip material 290 is again pressed. The seal is then cooled in the clamp cooling station 630. If necessary, any excess dip strip material 290 in the vicinity of the seal is removed by the punch 650. The pouches 10 are then serrated via the serration station 670. The loading servo 690 then loads the pouches 10 into the stacking device 700 for use or for transport to the customer.

Use

Figure 7:
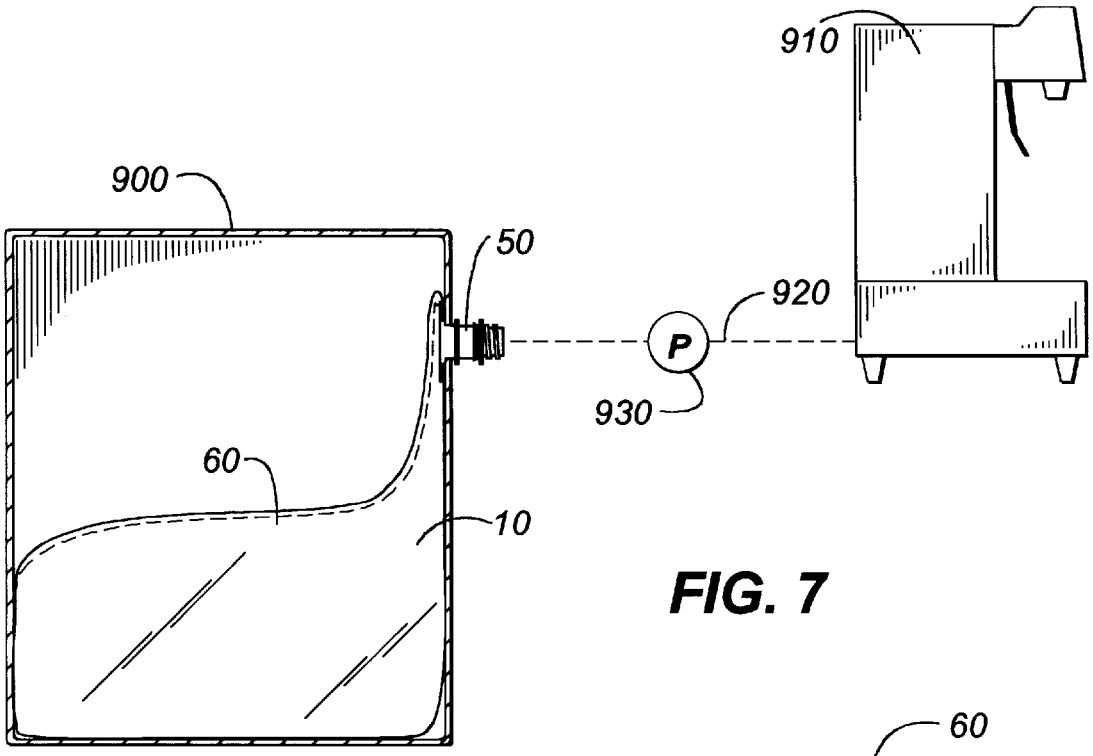
FIG. 7 is a diagrammatic view of a half full pouch of the present invention in a box and connected to a post-mix dispenser through a hose having a pump therein.

FIG. 7 shows a preferred use of the pouch 10 as a bag-in-box post-mix beverage system for supplying syrup to a post-mix soft drink dispenser. In such use, the pouch 10 is placed within a corrugated box 900. The box 900 is connected to a post-mix dispenser 910 by connecting the spout 50 of the pouch 10 to a syrup hose 920 having a pump 930 positioned therein. The syrup within the pouch 10 is evacuated under pressure. The dip strip 60 prevents the pouch 10 from collapsing upon itself before the pouch 10 is substantially empty. Further, because the dip strip 60 is connected to the upper wall 15 of the pouch 10, the fluid passages 74 within the dip strip 60 draws the syrup from the far reaches of the pouch 10. This straw-like action provides for increased efficiency in withdrawing syrup from the pouch 10.

It should be understood that the foregoing relates only to the preferred embodiments of the present invention and that numerous changes may be made herein without departing from the spirit and scope of the invention as defined by the following claims.

We claim:

1. A disposable liquid containing and dispensing package, comprising:

a flexible bag comprising an upper and a lower bag wall;

said upper and lower bag walls comprising a periphery and a middle portion;

said upper bag wall comprising a spout positioned within said middle portion of said upper bag wall;

said spout comprising a first side and a second side; and a dip strip attached to said upper bag wall on said first side of and spaced apart from said spout and attached to said middle portion of said upper bag wall on said second side of and spaced apart from said spout.

2. The package of claim 1, wherein said dip strip is attached to said upper bag wall at a predetermined distance from said spout.

3. The package of claim 1, wherein said dip strip is further attached to said periphery of said upper bag wall on said second side of said spout.

4. The package of claim 1, wherein said dip strip is attached to said periphery of said upper bag wall on said first side of said spout.

5. The package of claim 1, wherein said dip strip is attached to said middle portion of said upper bag wall on said first side of said spout.

6. The package of claim 1, wherein said dip strip is attached to said periphery of said upper bag wall on said first side of said spout and wherein said dip strip is further attached to said periphery of said upper bag wall on said second side of said spout.

7. The package of claim 1, wherein said dip strip is attached to said upper bag wall at a plurality of contact points.

8. The package of claim 1, wherein said dip strip comprises a flat base and a central ribbed portion.

9. The package of claim 8, wherein said central ribbed portion comprises essentially parallel ribs so as to provide a plurality of liquid passages.

10. The package of claim 8, wherein said central ribbed portion faces said upper bag wall.

11. The package of claim 8, wherein said dip strip further comprises a pair of flat ends.

12. The package of claim 11, wherein said flat ends comprise said flat base with said central ribbed portion removed.

13. The package of claim 11, wherein said flat ends are sealed between said bag walls at said periphery.

14. The package of claim 8, wherein said flat base of said dip strip is attached to said upper bag wall at one or more contact points.

15. The package of claim 14, wherein said one or more contact points comprise a pair of upper contact points.

16. The package of claim 14, wherein said one or more contact points comprise a pair of center contact points.

17. The package of claim 14, wherein said one or more contact points comprise a pair of lower contact points.

18. The package of claim 14, wherein said one or more contact points comprise a plurality of contact points and wherein said plurality of contact points are spaced apart from one another so as to allow fluid to pass between said plurality of said contact points to said dip strip.

19. The package of claim 1, wherein said bag walls and said dip strip comprise a plastic material.

20. The package of claim 19, wherein said dip strip is attached to said middle portion of said upper bag wall at one or more contact points.

21. The package of claim 20, wherein said contact points each comprise an area of fused plastic material.

22. The package of claim 1, wherein said dip strip comprises at least one elongated liquid passage thereon such that said elongated liquid passage is in liquid communication with said spout as said bag progressively collapses against said dip strip.

23. The package of claim 1, wherein said spout is located adjacent to said periphery at one end of said bag.

24. The package of claim 1, wherein said dip strip is extruded.

* * * * *